US009083153B2

(12) United States Patent
Ehrhardt et al.

(10) Patent No.: US 9,083,153 B2
(45) **Date of Patent: *Jul. 14, 2015**

(54) HORN SPARK GAP LIGHTNING ARRESTOR WITH A DEION CHAMBER

(75) Inventors: Arnd Ehrhardt, Neumarkt (DE); Stefanie Schreiter, Neumarkt (DE)

(73) Assignee: DEHN + SÖHNE GmbH + Co. KG, Neumarkt (DE)

( * ) Notice: Subject to any disclaimer, the term of this patent is extended or adjusted under 35 U.S.C. 154(b) by 287 days.

This patent is subject to a terminal disclaimer.

(21) Appl. No.: 13/813,452

(22) PCT Filed: Jul. 14, 2011

(86) PCT No.: PCT/EP2011/062041

§ 371 (c)(1),
(2), (4) Date: Apr. 17, 2013

(87) PCT Pub. No.: WO2012/016804

PCT Pub. Date: Feb. 9, 2012

(65) Prior Publication Data

US 2013/0208388 A1 Aug. 15, 2013

(30) Foreign Application Priority Data

Aug. 4, 2010 (DE) ..... 10 2010 033 293
Jul. 11, 2011 (DE) ..... 10 2011 051 738

(51) Int. Cl.
*H01T 4/00* (2006.01)
*H01T 4/14* (2006.01)

(52) U.S. Cl.
CPC ..... *H01T 4/14* (2013.01)

(58) Field of Classification Search
CPC ..... H01T 4/14
USPC ..... 361/137
See application file for complete search history.

(56) References Cited

U.S. PATENT DOCUMENTS 3,603,755 A * 9/1971 Ranzanigo ..... 200/466
4,551,697 A * 11/1985 Kussy ..... 335/16
7,259,646 B2 * 8/2007 Rab et al. ..... 335/201

(Continued)

FOREIGN PATENT DOCUMENTS

DE 131 548 6/1901
DE 24 19 731 11/1975 ..... H01T 1/04
DE 44 35 968 4/1996 ..... H01T 1/20
EP 0 860 918 8/1998 ..... H01T 4/10

(Continued)

OTHER PUBLICATIONS

The International Search Report (in English), dated Sep. 29, 2011, which issued from the ISA/European Patent Office for corresponding PCT Application No. PCT/EP2011/062041.

*Primary Examiner* — Stephen W Jackson
(74) *Attorney, Agent, or Firm* — Gerald T. Bodner

(57) ABSTRACT

The invention relates to a horn spark gap lightning arrestor with a deion chamber (6) for quenching arcs in a housing (1) and controlling the internal gas flow for adjusting a different response of the arc produced in the case of power pulse current loading, on the one hand, and of the arc induced by follow-on current, on the other hand. For this purpose, the distance between the opposite electrode faces of the horn spark gap in the striking region is kept very small and there is only a slight widening of the distance in the diction of the end of the horn spark gap in order to prevent undesired migration of the arc in the event of lighting pulse current.

15 Claims, 6 Drawing Sheets

(56) References Cited

U.S. PATENT DOCUMENTS

Figures 1A, 1B:
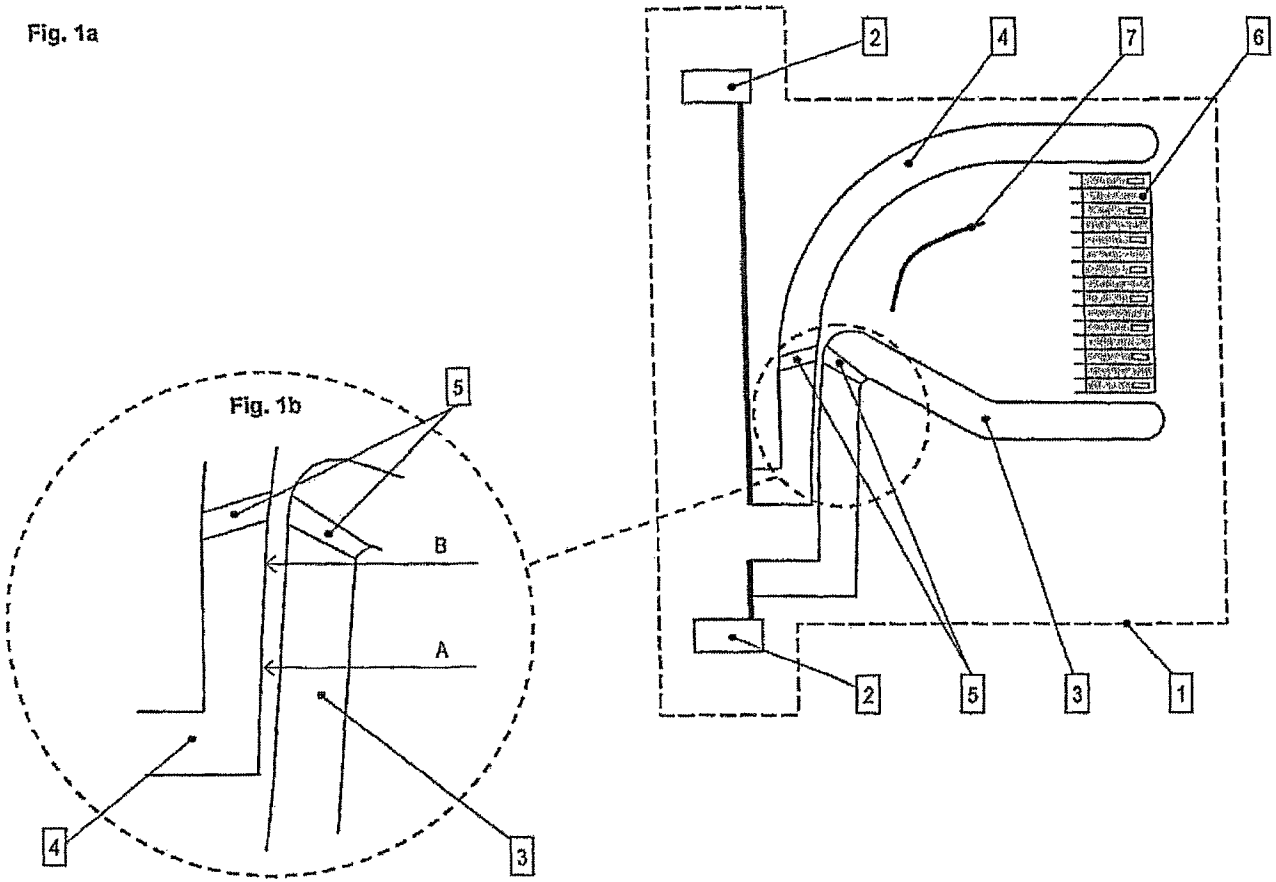

| | | | | |
|---|---|---|---|---|
| 8,873,217 | B2 * | 10/2014 | Hierl et al. | 361/257 |
| 2006/0104003 | A1 | 5/2006 | Gautier | 361/120 |

FOREIGN PATENT DOCUMENTS

| | | | |
|---|---|---|---|
| EP | 0 920 098 | 6/1999 | H01T 4/14 |
| EP | 1 535 378 | 6/2005 | H01T 4/10 |

* cited by examiner

HORN SPARK GAP LIGHTNING ARRESTOR WITH A DEION CHAMBER

The invention relates to a horn spark gap lightning arrester with a deion chamber for quenching arcs in a housing, also of a non-blowout design, and measures for setting a different response of the arc produced in the case of power pulse current loading, on the one hand, and of the arc induced by follow current, on the other.

An overvoltage protection element for dissipating transient overvoltages which is based on a horn spark gap is known from DE 44 35 968 C2. Each electrode of the horn spark gap there comprises a connection element and a spark horn, with the spark horn of the electrodes arranged at a distance from each other forming an air breakdown spark gap. Moreover, an arc quenching plate arrangement comprising a plurality of arc quenching plates is disposed within the housing of the overvoltage protection element, said arc quenching plate arrangement being disposed at a distance from the ends of the electrodes opposite the ends of the electrodes distal to the connection elements.

The known spark gap is of a blowout design and therefore requires complex and extensive protective measures. For realizing sufficient current limitation as well as ageing resistance with regard to the arising thermal and mechanical loads, the spark gap according to DE 44 35 968 C2 exhibits splitting of the electric arc, namely using two deion chambers, which likewise leads to additional costs.

Modern lightning arresters in series-mounted housings for low voltage applications are required to be of an encapsulated design. Such lightning arresters need to have a high follow current quenching capacity as well as high follow current limitation.

EP 1 535 378 B1 and EP 0 860 918 B1 show spark gaps capable of carrying lightning currents with deion chambers for series-mounted devices, which are of a blowout design, in which the exiting gases, however, are at least partially deionized. Also, these spark gaps do not have any possibility of function splitting between the pulse and follow currents which arise.

Basically, the use of the usual concept in the field of low voltage for limiting follow current by means of deion chambers in lightning arresters is problematic. The effective follow current limitation in using deion chambers is based on the arc's rapid entry into the respective quenching chamber. The time until entering the quenching chamber is short when a short distance can be realized between the ignition site and the deion chamber as well as a high arc travel speed. The travel speed of the electric arc, however, depends on numerous parameters, namely the electrode material, the flow resistance, the arrangement and the respective forces acting upon the arc among others.

Since the object of strongly limiting follow current requires the magnitude of the momentary follow current value always being smaller than the magnitude of the imposed pulse currents, a contradiction arises in that the forces supporting the arc movement increase along with the current magnitude according to Lorentz's law.

This leads to the fact in known horn spark gaps that when the follow current enters the quenching chamber rapidly and when there is good limiting of the follow current, the longer lasting pulse currents as well, and thus also the high-energy lightning pulse currents, will likewise enter the deion chamber. The deion chamber used hence needs to be thermally and correspondingly dynamically rated with respect to the imposed pulse currents.

Due to the splitting into a plurality of partial arcs, the arc voltage and hence the power conversion of a respective horn spark gap are significantly increased since there is no current limitation in the imposed pulse currents. The stress upon all parts of the arrester is therefore significantly increased. Same is particularly critical in an encapsulated arrangement since the power conversion takes place completely within the arrester. In contrast thereto, up to 90% of the power conversion in blowout arresters is dissipated to the environment.

One alternative to counteracting this heavy stress within the arrester is to temporally delay the arc's entry into the chamber by increased lengths respectively distances.

Although this prevents the pulse current arc from entering the arc chamber, the follow current limitation hereby resulting is, however, not acceptable. Reference should be made in this respect to DE 24 19 731 B2.

For the reasons mentioned above, it is therefore a task of the invention to propose a further developed horn spark gap lightning arrester with a deion chamber which exhibits optimum follow current limitation on the one hand and prevents imposed pulse currents of a high current amplitude from entering the deion chamber on the other so as to yield high service life and ageing resistance.

The task of the invention is solved by a feature combination according to the teaching as per claim 1, with the dependent claims at least representing appropriate configurations and further developments.

With the horn spark gap lightning arrester according to the invention, different arc responses in the case of follow and pulse currents are ensured even in a non-blowout design. This enables implementing the deion chamber as well as the horn electrodes in a cost efficient and space-saving manner, reducing the thermal and mechanical load on the arrester, reducing the expenditure for avoiding blowout phenomena and increasing service life. A simple, inexpensive and space-saving arrangement of an ignition aid in the form of a trigger electrode can also be realized.

Using the solution according to the invention succeeds in reducing through to fully preventing the load on the deion chamber due to imposed lightning surge currents. In a first embodiment of the invention, in a non-blowout, i.e. encapsulated, horn spark gap, the pulse current arc is virtually fixed in the ignition region of the horn electrodes due to the particular configuration of the ignition region and the targeted control of the pressure reflections within the spark gap, while the follow current arc can enter the arc chamber within a clearly shorter period of time and is limited.

The invention is based on a horn spark gap lightning arrester with a deion chamber for quenching arcs in a housing of a non-blowout design and controlling the internal gas flow to set a different response for the arc produced in the case of pulse current loading on the one hand and of the arc induced by follow current on the other.

For this purpose, the distance between the opposite electrode faces of the horn spark gap in the ignition region is kept very small in order to prevent undesired migration of the arc in the event of lightning pulse currents. Furthermore, the arrangement of the electrode faces facing each other in the ignition region extends essentially in parallel or has only a slight widening of the distance toward the end of the horn spark gap. Due to these geometric measures in the ignition region, the force acting upon the pulse current arc is minimized. In addition, the pressure waves produced by the arc during the lightning pulse current discharge in the ignition region of the spark gap are induced to perform a defined reflection upstream, at or downstream the deion chamber. The action of force of the reflected pressure wave or waves is utilized to further reduce or compensate the current forces which could cause undesired movement of the lightning pulse current arc in the direction of the deion chamber. The effectiveness of these pressure reflections for keeping the arc at its current level is in particular restricted to lightning-induced pulse surge currents and is temporally limited. Using the magnitude, the duration and the energy content of the lightning pulse current, the intensity and length of time of the reflection front's active forces are controlled in the measures taken such that the critical high-energy lightning pulse surge currents in particular are very effectively forced to dwell at the ignition site.

The measures discussed above can also be used in a completely encapsulated horn spark gap with a deion chamber for limiting the current of the follow current arc without the internal gas circulation, which promotes the mobility of the follow current, also propelling the lightning pulse surge current into the deion chamber. The temporally delayed gas flow which passes through the deion chamber in such a spark gap is passed back at least partially to the arc travel path of the spark gap via deflection means.

As stated above, a trigger electrode can be arranged in the ignition region.

The trigger electrode includes a conductive element which is surrounded by a sliding path or comprises adjoining sliding paths of an insulating or semiconducting material.

The trigger electrode is either inserted into one of the two electrodes in the ignition region or disposed between the two electrodes of the horn spark gap, and namely preferably in the lower area of the ignition region.

The sliding paths can be arranged or realized respectively to be asymmetrical.

The special configuration of the ignition region and the utilization of the pressure reflection within the lightning arrester in the solution according to the invention achieves minimizing the forces acting upon the lightning pulse current as a result of the current amplitude.

At the beginning of its development, the pulse current arc tends toward diffuse behavior. This behavior promotes the existence of several arc center points and an electric arc which is not yet strongly contracted. Excessively narrowing respectively cooling the arc in the initial phase of the arc by adjoining elements such as sliding aids, a housing wall, ceramic plates or the like causes increasing the power conversion in the plasma and the arc transforming more rapidly into the state of a thermal plasma. In this state, the arc contraction is clearly more strongly pronounced and the arc more strongly exposed to the forces acting upon it which favor undesired migration during loading by imposed lightning pulse currents.

The above-mentioned effect is counteracted by reducing the distance of the electrodes in the ignition region to a value of less than 1.2 mm, preferably 0.8 mm. Furthermore, the active electrode faces are approximately equally spaced within the ignition region. This approximate equal spacing is in particular present in the area above the ignition site in the travel direction of the arc. The slight initial widening; i.e. the minimum change in distance between the diverging electrodes prevents or restricts the electric arc from running out. The extent of the initial widening of the distance between the diverging electrodes should be at most 50%.

In one preferred embodiment, the width of the active electrode face is set to at least 2 mm. With pulse currents of up to 50 kA, an active electrode width of 2 mm to 6 mm is preferred and sufficient.

It was found that a current density of less than 2 kA/mm$^2$, preferably 1 kA/mm$^2$, relative the amplitude of the imposed pulse current can be realized under the conditions of normal air atmosphere in order to constructively avoid a constriction of the electric arc at the point of origination.

A sufficiently large electrode face, low constriction and short arc length allow for reducing the action of force which leads to undesired migration of the arc into the deion chambers, particularly during the arc phase prior to reaching the thermal balance. The thermal time constant of the arc in air can thus amount to about 10 μs to 100 μs.

Since the contraction of the pulse current-induced arc cannot be infinitely delayed by the mentioned measures, the arc will contract at the latest behind the lightning pulse after reaching the thermal balance and be exposed to increased action of force. In this critical phase, the reflection of the pressure wave becomes effective according to the invention by the described arrangement of flow obstacles within the gas circulation.

Apart from reducing the effect of current forces within the horn arrangement for the pulse current arc, the flow cross-section and flow resistance in the presented arrester with internal gas circulation are configured such that the reflection of the pressure wave produced by the pulse current itself counteracts the arc's movement.

The increase in flow resistance in the inlet area of the deion chamber, but also the resistance of flow when venting the deion chamber, can be used as a reflection front for this purpose.

For designing the pressure reflection to be optimum, the propagation speed of the pressure wave in the respective medium needs to be taken into account. The first reflected pressure wave in this case should not necessarily strike the arc prior to reaching the intrinsic dwell time of up to several 10 μs which is inter alia material-dependent. Times which are significantly longer than 100 μs, or longer than the return half-time of the lightning current pulse respectively, should be avoided.

Due to the geometric configuration in the ignition region of the spark gap, only minimum forces act upon the lightning pulse current arc, as already discussed, which would cause the arc to move in the direction of the deion chamber. The reflections generated at the flow obstacle(s) lead to pressure waves which reach the lightning pulse current arc at the latest after the intrinsic dwell time and are as effective as possible until reaching the return half-life of the pulse current as well as capable of sufficiently compensating the forces driving the arc by their oppositely acting force. To reach this objective, reflection waves can be selectively produced on one or more flow obstacles staggered in accordance with the flow path. These measures allow for generating pressure reflections having different travel times or frequencies and utilizing the temporally staggered single forces thereof or else a superimposition of these forces over the critical period.

The invention will be explained hereinafter in more detail on the basis of an exemplary embodiment and by means of figures.

Figure 2:
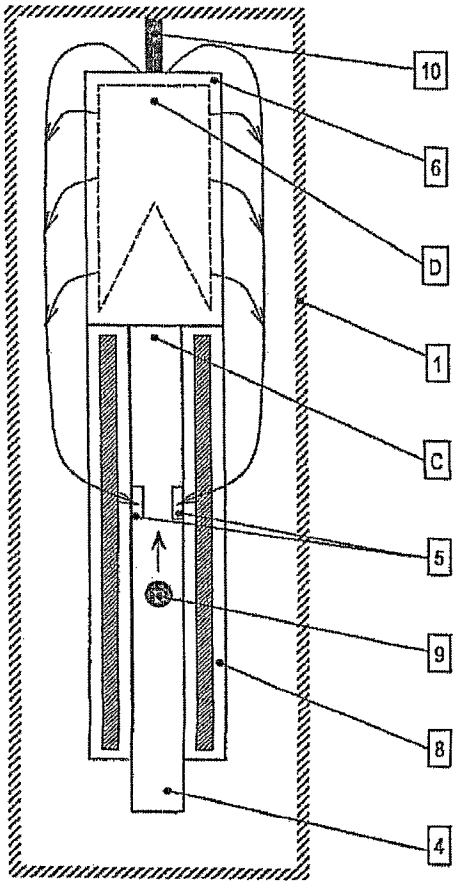
Figure 3:
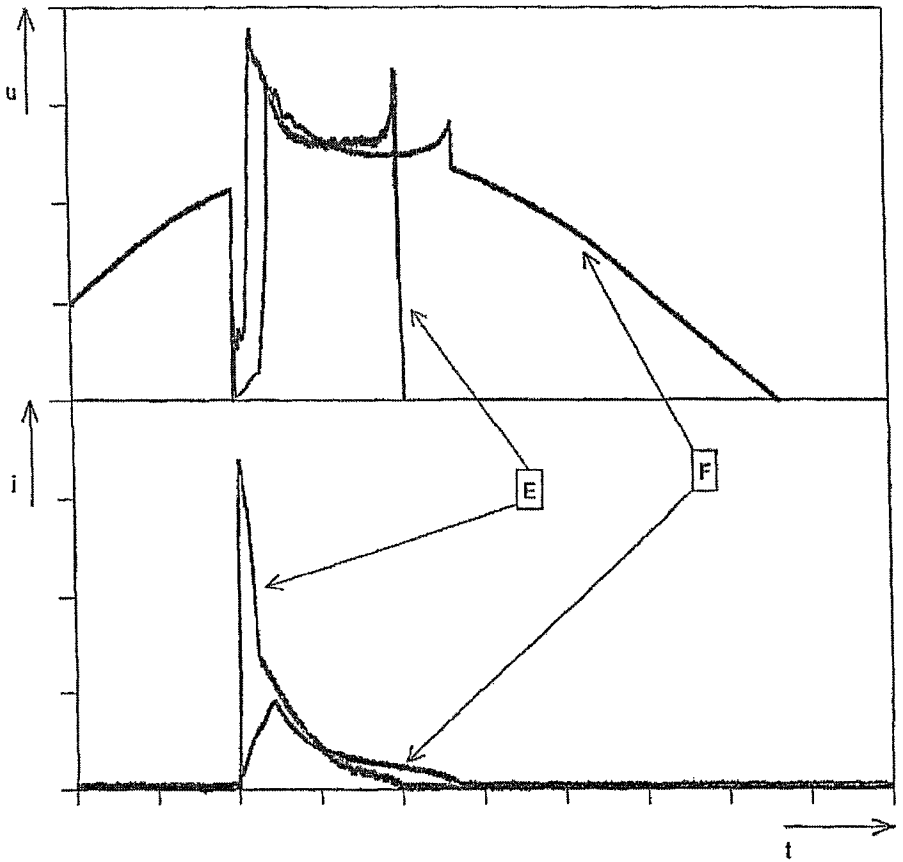
Figure 4:
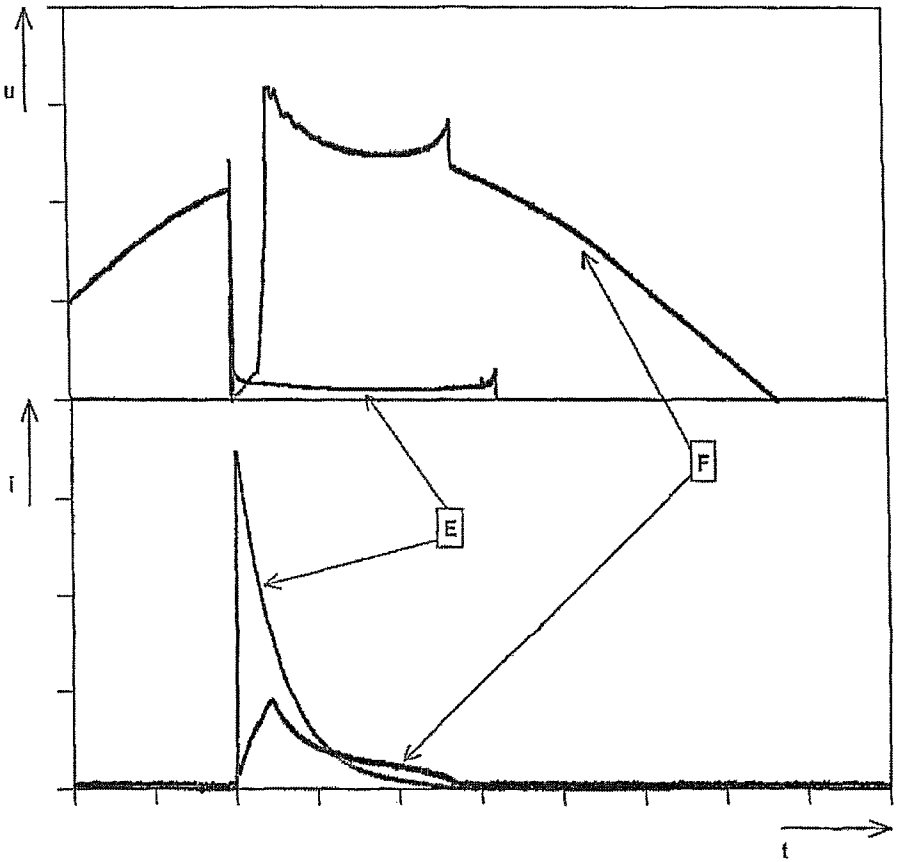
Figure 5:
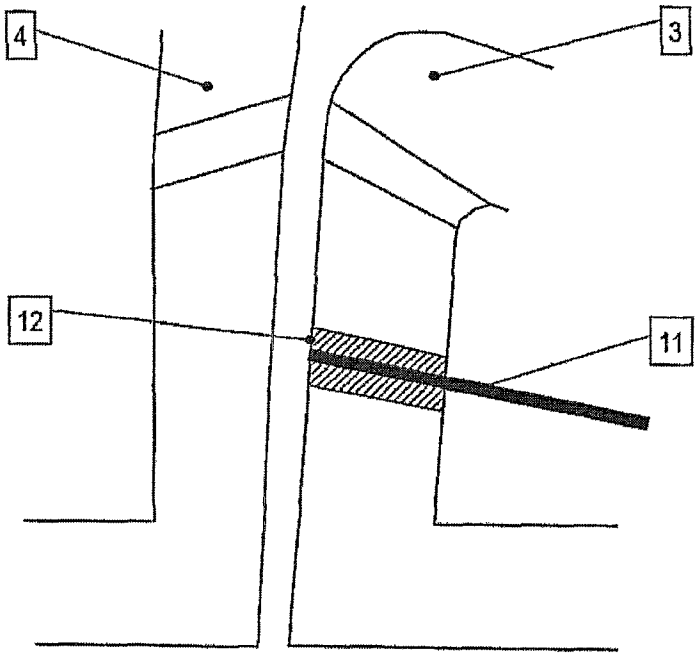
Figure 6:
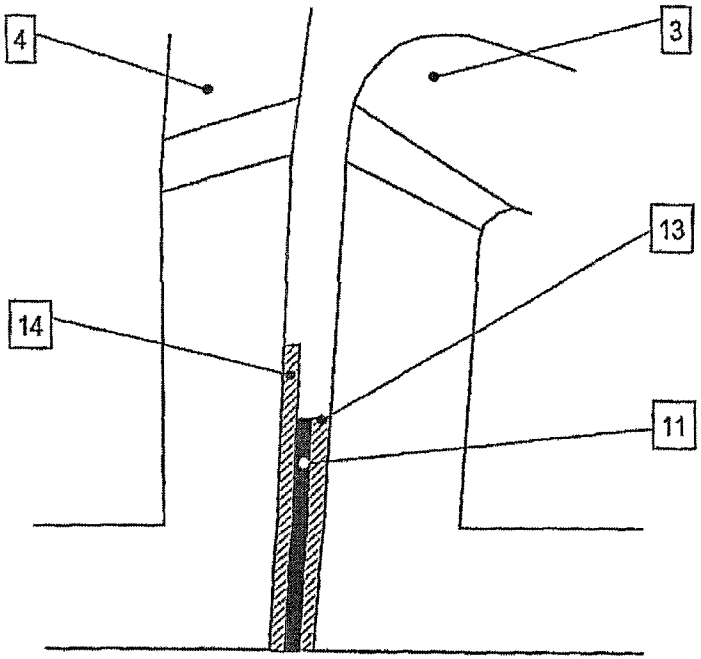

Shown are in:

FIG. 1*a* a schematic representation of the horn spark gap lighting arrester according to the invention with the arrangement of the horns and schematic configuration of the deion chamber;

FIG. 1*b* a detailed representation of the ignition region of the electrodes of the horn spark gap;

FIG. 2 a lateral view of the representation as per FIG. 1*a* with the gas flow outlined back to the flow openings in the electrodes of the horn spark gap;

FIG. 3 the superimposition of current and voltage curves in a usual encapsulated horn spark gap with a deion chamber at a pulse E and follow current loading F;

FIG. 4 a representation similar to that as per FIG. 3, however, of current and voltage curves of the horn spark gap according to the invention;

FIG. 5 a representation of the ignition region of the horn spark gap with a trigger electrode which is introduced into one of the spark horn's electrodes, and FIG. 6 a representation of the ignition region of the inventive horn spark gap lightning arrester arrangement with a trigger electrode between the two slightly diverging main electrodes.

The basic embodiment of the horn spark gap lightning arrester arrangement according to the invention can be understood with reference to FIG. 1*a*. The spark gap arrangement is in this case integrated into a series-mounted housing 1 and has two connecting terminals 2.

The spark gap exhibits two slightly diverging electrodes 3 and 4 having recesses 5 for the gas circulation and follow current arc flow.

The deion chamber 6 having openings for gas circulation is located between the strongly diverging portions of the electrodes 3 and 4 in the end regions thereof.

The travel path of the arc between the ignition region (see detailed representation as per FIG. 1*b*) and deion chamber 6 is laterally delimited by insulating plates (see FIG. 2, reference numeral 8).

The deion chamber 6 preferably features reciprocal ventilation of the individual deion chamber sections. These openings are positioned both laterally and on the front side of the deion chamber 6.

The gases are introduced into the travel path of the spark gap via the cited lateral recesses 5 in the electrodes 3 and 4. In this case, these lateral flow openings or recesses 5 lie above the area where the arc stagnates during a load being applied by a lightning pulse current (see FIG. 1*b*).

In order to distribute the returning gases to the individual recesses or flow openings 5 in a targeted manner for better supporting the arc movement in the case of follow current, the volume of gas flowing out from the deion chamber 6 is split up into a plurality of individual gas flows by a splitter 7.

This splitter 7 moreover prevents gas from flowing directly from the deion chamber 6 into the lateral recesses 5, whereby still heated and/or ionized gases are not supplied back to the travel path even at very high arc loads. In addition, the introduction of combustion products or respective combustion particles is prevented.

The splitter 7 can be realized as an angled small partition, for example, and is situated in the gas expansion area; i.e. in the area where gases flow in from the travel path and the arc chamber. The splitter 7 serves as a partitioning or deflecting wall for the gases in this area which are still fed from the arc chamber at a high temperature and are again supplied to the arc travel path through bilateral grooves in the electrodes. The relatively direct gas flow from the arc chamber strikes the splitter in a bundled form and is split in two flows having a longer path, inter alia for cooling and distributing in terms of a diffuse flow, which both enter the gas supply openings in the electrode area. The still heated gas is hence split on both sides into two flows, cooled, and in addition, loose conducting particles are prevented from being introduced into the electrode area. The present splitters support the uniform distribution of the cooled gases to all return flow openings in the arc travel path. This uniform distributing is of high importance for optimally supporting the travel behavior of the follow current arc. For instance, when only one return opening is utilized, the relatively narrow follow current arc could easily escape from the movement-supporting action of the targeted internal gas circulation. This would counterproductively lead to very long arc travel times from the ignition site to the arc chamber or even to arc idling, whereby a failure of the spark gap would be possible. The splitter thus supports the primary basic functionality of encapsulating the horn spark gap, namely the internal targeted gas circulation for ensuring the travel behavior of the follow current arc and hence the follow current limitation and quenching.

As compared to the ventilation openings in the deion chamber 6, the cross-section of the recesses 5 in the electrodes is selected to be very small and is less than 10% of the ventilation opening cross-section in an exemplary implementation.

FIG. 1*b* shows the ignition region of the arc developing between electrodes 3 and 4 below the recesses 5 for the gas circulation in detail.

The ignition of the electric arc may be active or passive.

The electric arc develops here between the two electrodes 3 and 4 in section A.

The distance of the electrodes in section A is between 0.8 mm and 1.2 mm in the exemplary embodiment.

The surface area in which the electric arc dwells during loading by lightning pulse current extends at most up to section B. The widening of the diverging electrode distance at section B amounts to a maximum of 50% as compared to section A.

The resulting electrode surface area between sections A and B corresponds at least to the surface area which results from the quotient of the maximum amplitude of the imposed pulse current and the preferable current density of 1 $kA/mm^2$.

FIG. 2 shows the cross-section of the deion chamber as well as the positioning of preferred reflection areas.

Here as well, a series-mounted housing 1 with a spark gap and the visible electrode 4 and lateral recesses 5 for the gas circulation between the deion chamber 6 and the arc travel path are taken as the basis.

The arc travel path is delimited by insulating cover plates 8.

The follow current arc 9 runs along the diverging electrodes 3, 4 to the inlet section C of the deion chamber 6 and is then distributed to the individual chamber sections. The deion chamber 6 has lateral and frontal ventilation openings (represented by arrows), through which the areas between the single plates of the deion chamber, each having a V-shaped notch, are reciprocally ventilated. The single plates having the V-shaped notch are shown in dotted lines within the deion chamber 6.

On the front side of the deion chamber, the ventilation is also divided in the axial direction of the chamber by an insulating web 10.

The flow resistance in the inlet section C of the deion chamber 6 can also be influenced, apart from the selection of the distance of the single plates, the configuration of the V-shaped notch and the distance of the respective first single plate of the deion chamber to the respective electrodes or deflecting plates 3, 4, by further measures.

The V-shaped notches of the deion chamber can be additionally tamped by means of an insulation.

Additional narrowing means can be disposed below the deion chamber 6 as a flow obstacle on the lateral insulating plates 8 of the arc travel path.

The flow resistance in the ventilation section D of the deion chamber 6 can be influenced and predetermined by the number, size and shape of the ventilation openings.

The described option of positioning a flow obstacle below the deion chamber serves the purpose of generating reflection fronts near the dwelling area of the lightning pulse current arc. At the same time, this measure causes the running of the follow current arc into the deion chamber to be accelerated. The described, bilaterally arranged wedge-shaped narrowing in the arc inlet area can be highly variably utilized to control the flow resistance by varying the wedge shape unto a solid block as well as the remaining channel width.

The flow resistance can even be changed by the volume and the geometry of the reflux channels next to and above the deion chamber 6. Basically, both the reflection of the pressure wave in the inlet section C and in the ventilation section D are suited to aid in making the pulse current arc dwell directly in the vicinity of the ignition region (see FIG. 1*b*) of the electrodes 3, 4. The requirements in terms of the pulse loading capacity and the quenching capability during follow current based on the configuration of the spark gap are decisive when selecting the more favorable reflection range.

The measures presented according to the invention cause lightning pulse currents to safely remain in the ignition region between section A and section B of the spark gap with dwell times of several ms.

At a prospective follow current of e.g. 50 kA, however, the running into the deion chamber 6 and the limitation thereof takes place within a maximum of 1 ms. The momentary value of the follow currents is thereby limited to values of a few kA. The efficiency of the measures according to the invention can be understood on the basis of comparing the representations of FIGS. 3 and 4.

FIG. 3 shows a superimposition of current curves (bottom) and voltage curves (top) of a common encapsulated horn spark gap with a deion chamber during pulse loading (E) and follow current loading (F).

It can be recognized that the electric arc enters the deion chamber very quickly during pulse current because of the high current slopes and amplitude. The energetic stress of the deion chamber is very high due to the imposed pulse current which in practice cannot be limited when entering the chamber. The parts of the entire spark gap are exposed to disproportionately high stress by the pressure effect and the thermal load. The energy conversion in the deion chamber at 25 kA 10/350 μs is in the range of up to 7 kJ.

Due to the follow current limitation realized, the specific energy at a prospective follow current of 25 kA is only 2 $kA^2s$. At a pulse loading of 25 kA 10/350 μs, however, this value is about 100 times higher. The configuration of the spark gap according to the invention, however, enables the parts of the arc chamber, respectively the entire spark gap, to be designed for a significantly lower energetic stress. Energetically highly loadable and thus cost-intensive material is only necessary in the ignition region of the horn spark gap between sections A and B.

FIG. 4 shows the behavior of an encapsulated horn spark gap according to the invention. The curve of the arc voltage and the current limitation at follow current loading (F) correspond to the equivalent curves (F) as per FIG. 3. During loading with a pulse current (E), the electric arc according to the invention remains in the ignition region of the two electrodes so that the thermal and dynamic stress of the entire spark gap is reduced to a fraction of the stress of a spark gap according to the curves as per FIG. 3, due to a significantly lower arc voltage.

In the inventive embodiment of the spark gap, the energy conversion at a pulse loading with 25 kA of the pulse shape 10/350 μs is reduced by at least a factor of 10 compared to a spark gap without a corresponding functional splitting with respect to follow current and lightning pulse current.

The configuration of the possible non-blowout spark gap according to the invention enables drastically reducing the energy conversion which stresses all parts of the spark gap to 100% due to the encapsulation. It is hereby in turn possible to reduce the size and the constructional expenditure is lower. Finally, simpler and hence less expensive materials can be used.

The configuration of the ignition region in a further embodiment ensues by utilizing a trigger electrode.

In this case, use can be made of an implementation as an air spark gap as per FIG. 5 and/or sliding spark gap as per FIG. 6.

FIG. 5 shows an embodiment with a trigger electrode 11 in the ignition region. The trigger electrode 11 and sliding path 12 are guided through a recess within or at the side of one of the two main electrodes 3, 4. This variant is particularly suited for a sliding path-free implementation of the spark gap between the two main electrodes 3, 4.

The ignition arrangement shown in FIG. 5 is moreover very well protected thermally and mechanically due to the burnoff-resistant electrode material of the respective main electrode and thus particularly resistant to ageing. This is particularly advantageous for the presented embodiment of the horn spark gap since the dwelling of the electric pulse current arc in the ignition region is also a higher load to the trigger electrode. Using the presented embodiment of the arrangement of the trigger electrode, it is moreover particularly easy to realize the short distance—which is necessary for the presented embodiment—between the two main electrodes 3, 4 at very good insulation values.

As an alternative to an arrangement of the trigger electrode 11 between the two diverging main electrodes, a lateral arrangement of the trigger electrode is also conceivable.

According to FIG. 6, the trigger electrode 11 is located between the two main electrodes 3 and 4. The trigger electrode 11 is in this case disposed between two sliding paths 13, 14. In a preferred asymmetrical configuration of the sliding paths 13, 14, a vertical superelevation and/or thicker design of sliding path 14 can be selected. This results in improving the insulation value as well. An implementation of one or even both sliding paths as an air gap is likewise within the spirit of the invention.

The sliding paths 12, 13 which are flashed over upon ignition of the spark gap can be realized according to prior art as purely insulating paths or else as a combination of an insulating path having a negligible response voltage and an extension of electrical material to be flashed over by the electric arc.

In the event of purely an insulating path, use of an ignition transformer will provide for increased ignition voltage. Only one voltage switching element is basically required as a flashover aid in the embodiment using electrically conductive material.

It is important in the presented trigger variants that, due to the short distances of the two main electrodes 3, 4 according to the invention, the ignition delay time of the entire spark gap can be selected when needed to be very short, whereby the energetic stress and thus also the size is very small. The short distance of the main electrodes moreover ensures the function of a passive arrester at a protection level of a maximum of 4 kV, for example, upon failure of the trigger circuit.

In an embodiment of the invention using electrically conductive material as a flashover aid, basically only one voltage switching element and/or current-limiting element such as a resistor, varistor, posistor or the like is required.

The invention claimed is:

1. A horn spark gap lightning arrester with a deion chamber for quenching arcs in a housing and measures for setting a different response of the arc produced in the case of pulse current loading, on the one hand, and of the arc induced by follow current, on the other, wherein for this purpose the distance between opposite electrode faces of the horn spark gap in the ignition region is kept small and the arrangement of the opposite electrode faces in the ignition region has a slight distance widening in the direction of the end of the horn spark gap.

2. The horn spark gap lightning arrester according to claim 1, characterized in that the distance of the opposite electrode faces in the ignition region is smaller than 1.5 mm, preferably in the range of between 0.5 mm and 0.8 mm.

3. The horn spark gap lightning arrester according to claim 1, characterized in that the divergence of the distance widening of the opposite electrode faces in the ignition region is at most 50%.

4. The horn spark gap lightning arrester according to claim 1, characterized in that the width of the electrode faces in the ignition region is essentially between 2 mm and 6 mm.

5. The horn spark gap lightning arrester according to claim 1, characterized in that the arrangement is integrated into a series-mounted housing, wherein the housing has slot-shaped or slit-shaped openings for pressure compensation.

6. The horn spark gap lightning arrester according to claim 1, characterized in that the travel path of the respective electric arc is laterally delimited by insulating plates covering the electrodes, wherein the plates extend from the ignition region to the deion chamber.

7. The horn spark gap lightning arrester according to claim 1, characterized in that the cross-sectional area of the flow openings in the electrodes is substantially smaller that the total surface of the flow outlet openings of the deion chamber.

8. The horn spark gap lightning arrester according to claim 1, characterized in that the deion chamber comprises a plurality of spaced individual plates each having a V-shaped notch, the V-opening of which is directed toward the horn spark gap in order to set or define the flow resistance in the inlet area of the deion chamber by selecting the distance of the individual plates and/or an additional tamping.

9. The horn spark gap lightning arrester according to claim 8, characterized in that the deion chamber comprises ventilation openings, by the number, size and shape of which the flow resistance in the inlet area of the deion chamber can be influenced or predetermined.

10. The horn spark gap lightning arrester according to claim 1, characterized in that a trigger electrode is arranged in the ignition region.

11. The horn spark gap lightning arrester according to claim 10, characterized in that the trigger electrode includes a conductive element which is surrounded by a sliding path or comprises adjoining sliding paths.

12. The horn spark gap lightning arrester according to claim 10, characterized in that the trigger electrode is inserted into one of the two electrodes in the ignition region or disposed between the two electrodes of the horn spark gap.

13. The horn spark gap lightning arrester according to claim 11, characterized in that the sliding paths are of an asymmetrical arrangement or implementation.

14. The horn spark gap lightning arrester according to claim 1, characterized in that a gas circulation is provided such that the pressure wave produced by the lightning pulse current-induced arc is reflected from the deion chamber and/or flow obstacles and counteracts the arc movement and the gas flow passing through the deion chamber is passed back at least partially to the ignition region via deflection means and passed to flow openings provided in the electrodes in order to assist the arc movement in the event of follow currents in the direction of the deion chamber, wherein for this purpose the flow openings are located above the ignition region in the direction of the deion chamber.

15. The horn spark gap lightning arrester according to claim 8, characterized in that at least one flow obstacle is arranged in the inlet area of the deion chamber, which is utilized for generating reflection fronts near the dwelling area of the lightning pulse current arc and at the same time causes the running of the electric follow current arc into the deion chamber to be accelerated, wherein the flow obstacle can be implemented as a wedge-shaped narrowing in the arc travel path.

* * * * *